United States Patent [19]

Muntjanoff et al.

[11] 4,313,633

[45] Feb. 2, 1982

[54] SELF ADJUSTING ACTUATOR SYSTEM

[75] Inventors: John R. Muntjanoff, Aurora; Charles E. Lanchantin, Jr., Peoria, both of Ill.

[73] Assignee: Caterpillar Tractor Co., Peoria, Ill.

[21] Appl. No.: 94,256

[22] Filed: Jul. 11, 1979

[51] Int. Cl.[3] ..... B66C 3/16; F15B 13/042

[52] U.S. Cl. ..... 294/88; 91/437; 91/441; 91/450; 414/730; 414/739

[58] Field of Search ..... 91/437, 440, 441, 449, 91/450, 464, 436; 414/739, 730; 294/88

[56] References Cited

U.S. PATENT DOCUMENTS

| | | | |
|---|---|---|---|
| 1,807,173 | 5/1931 | Ray . | |
| 2,367,682 | 1/1945 | Kehle . | |
| 2,401,680 | 6/1946 | Eaton . | |
| 2,986,123 | 5/1961 | Augustin . | |
| 3,090,359 | 5/1963 | Hoppenstand | 92/63 |
| 3,302,530 | 2/1967 | Dobrikin et al. . | |
| 3,631,989 | 1/1972 | McCormick . | |
| 3,668,976 | 6/1972 | Hieber et al. . | |
| 3,757,646 | 9/1973 | Rohner | 91/438 |
| 3,759,144 | 9/1973 | Ikeda . | |
| 3,854,766 | 12/1974 | Jordan . | |
| 3,865,424 | 2/1975 | Jabkowski . | |
| 3,877,575 | 3/1975 | Stedt . | |
| 4,005,894 | 2/1977 | Tucek | 294/88 |
| 4,147,325 | 4/1979 | McGee . | |
| 4,201,510 | 5/1980 | Muntjanoff | 414/730 |

FOREIGN PATENT DOCUMENTS 265649 10/1970 U.S.S.R. .

*Primary Examiner*—Irwin C. Cohen
*Attorney, Agent, or Firm*—Joseph W. Keen

[57] ABSTRACT

A self adjusting actuator system (32/32') has an actuator housing (40), a telescoping piston (52) defining therewith head and rod end chambers (58,60), and a compression spring (66) disposed for biasing the piston (52) in a preselected direction against an external force. A control system supplies fluid selectively to either of the chambers (58,60) and includes control device (33/33') for selectively permitting egress of fluid from the rod end chamber (60) to permit the piston (52) to move in the preselected direction in response to a change in the external force. Such system is particularly useful in a log grapple (10).

14 Claims, 3 Drawing Figures

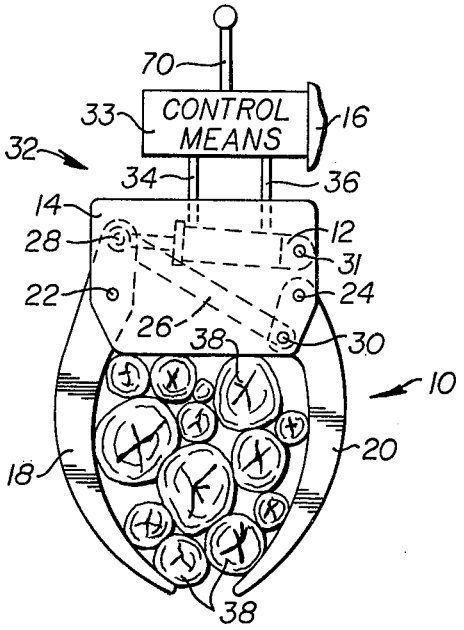
FIG. 1.
FIG. 2.
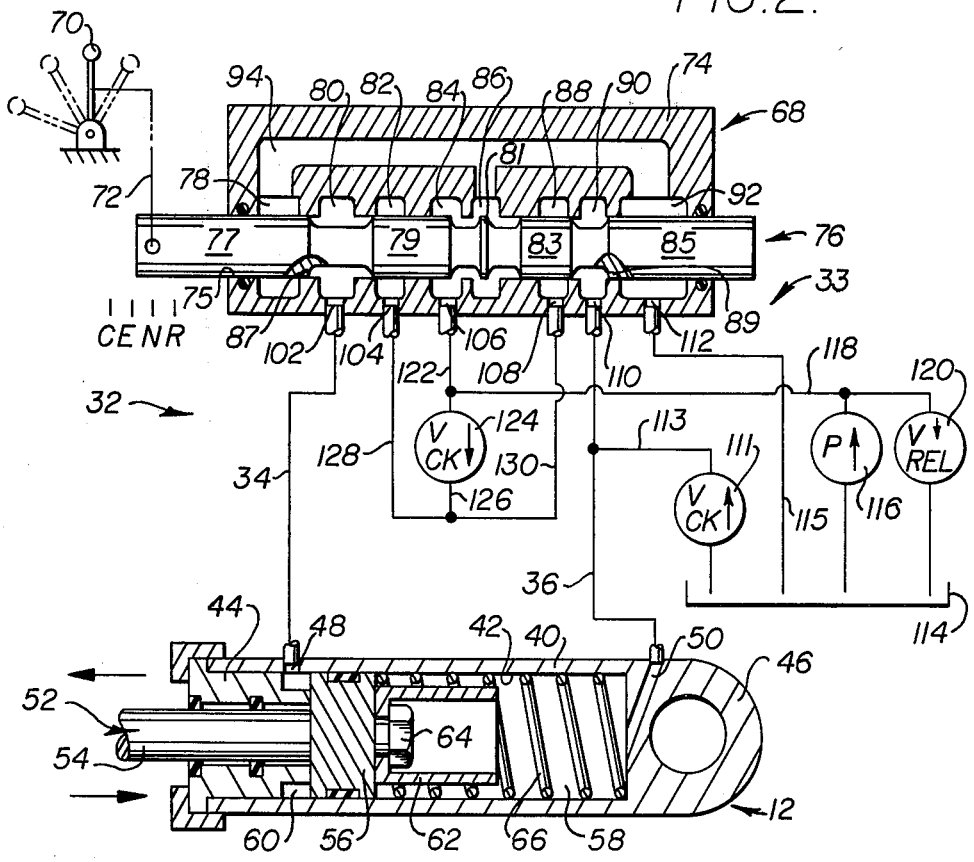

70'
72'
94
80
82
84
86
88
90
74
68'
78
92
77
79
83
85
76'
89
E N R
75
87
102
104
106
108
110
112
122
33'
118
131
32'
128
124
V CK
126
130
113
111
V CK
115
116
P
120
V REL
114
123
132
134
136
138
121
36
71
73
127
128
125
114
129
114
130
44
48
42
40
50
46
54
52
64
12
60
56
62
66
58

SELF ADJUSTING ACTUATOR SYSTEM

DESCRIPTION

1. Technical Field

This invention relates generally to a fluid powered actuator system and, more particularly, to a system that permits automatic adjustment in response to a change in the external force acting thereon.

2. Background Art

Fluid powered actuator systems including a reciprocating actuator or double-acting hydraulic jack are well known in load clamping mechanisms, for example, the apparatus disclosed in U.S. Pat. No. 3,631,989 to J. I. McCormick on Jan. 4, 1972. Similarly, log grapples frequently use one or two hydraulic jacks for swinging one or more arms on a frame into a clamping relationship with a load of logs as disclosed in U.S. Pat. No. 4,005,894 to F. J. Tucek on Feb. 1, 1977. An operator manipulates a control system connected to the jacks to selectively direct fluid to either end thereof for clamping and releasing the load.

A problem arises with these conventional load clamping mechanisms in that during a traveling or load carrying mode of operation at least one end of the jack or jacks is blocked in a fluid-pressurized state. Frequently, in logging operations, while the load is being transported, especially over rough terrain, the logs will shift and the load girth will become smaller. The prior art mechanisms have been unable to automatically compensate for such changing conditions. As a result, the operator must be alert to manually respond to the shifting of the load or he could drop it with resultant possible damage thereto or a loss in production.

Leakage in the actuator or its associated control system can also cause a decrease in the clamping force after an extended period of holding time with somewhat the same results. Heretofore, accumulators and other sophisticated components such as taught by U.S. Pat. No. 3,854,766 to B. L. Jordan on Dec. 17, 1974 and U.S. Pat. No. 3,865,424 to F. Jabkowski on Feb. 11, 1975 have been incorporated into the system to minimize the problem.

In view of the above, it would be advantageous to provide a simple and reliable fluid powered actuator system which can controllably and automatically adjust the overall length of its actuator in response to a change in the external force acting thereon.

DISCLOSURE OF THE INVENTION

In one aspect of the present invention, a self adjusting actuator system has an actuator housing, a telescoping piston defining therewith first and second chambers and urging means for biasing the piston in a preselected direction against an external force. A control system supplies fluid selectively to either of the chambers and includes a control spool having first and second operating positions for extending and retracting the actuator, and a third operating position. Advantageously, first means are provided for permitting egress of fluid from the second chamber in the third operating position of the control spool to permit the piston to move in the preselected direction in response to a change in the external force.

BRIEF DESCRIPTION OF THE DRAWINGS

FIG. 1 is a diagrammatic elevational view of a load clamping mechanism employing the self adjusting actuator system of the present invention.

FIG. 2 is a diagrammatic and enlarged sectional view of the actuator system shown in FIG. 1.

BEST MODE FOR CARRYING OUT THE INVENTION

Figure 3:
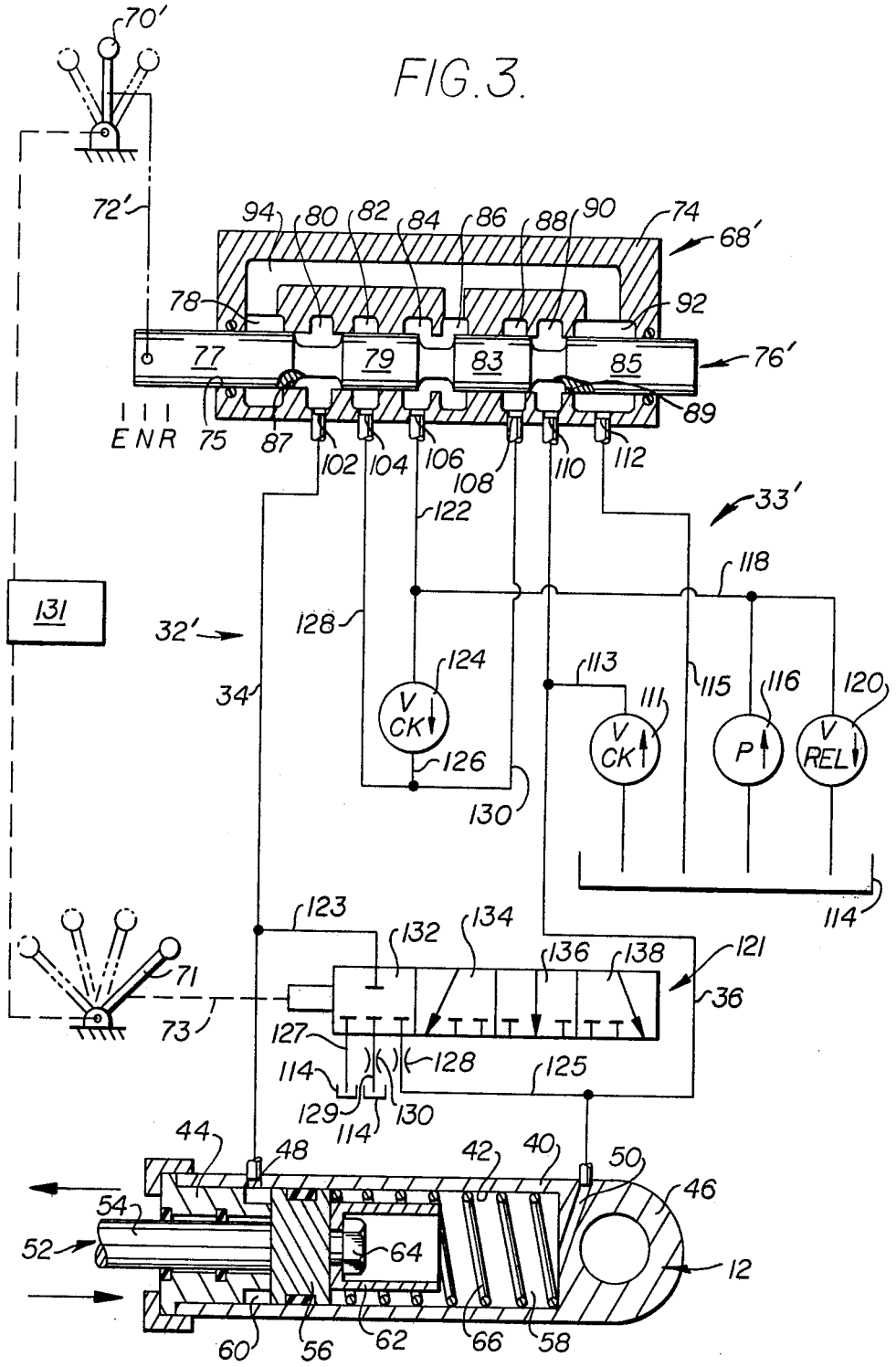
FIG. 3 is a diagrammatic and enlarged sectional view of an alternate embodiment actuator system constructed in accordance with the present invention that can be used with the load clamping mechanism illustrated in FIG. 1.

Referring to FIG. 1, a load clamping or grapple mechanism 10 has a self adjusting, fluid powered actuator or double-acting hydraulic jack 12. The clamping mechanism is, for example, of the log grappling type employing a frame or first member 14 suitably mounted on a vehicle fragmentarily represented by the reference numeral 16. A pair of clamping arms or second members 18 and 20 are pivotally secured to the frame at a pair of pivot joints 22 and 24, respectively, and an interconnecting link 26 is coupled between the clamping arms at a pair of pivot joints 28 and 30 so that both arms open and close together. The actuator 12 is pivotally mounted at one end on the frame 14 at a pivot joint 31 and is connected at its other end to some portion of the clamping arms or interconnecting link, for example, to the pivot joint 28.

In the embodiment of the present invention shown in FIGS. 1 and 2, a self adjusting actuator system 32 includes the aforementioned actuator 12 and a control means 33 therefor. The control means is in fluid communication with the actuator via a rod end conduit 34 and a head end conduit 36, so that the actuator's length can be selectively controlled by an operator to meet the working conditions encountered. Particularly, extension of the actuator will cause rotation of the clamping arm 18 about the pivot point 22 in a counterclockwise direction when viewing FIG. 1, while the link 26 simultaneously rotates the clamping arm 20 in a clockwise direction about the pivot point 24. In this manner the arms are brought together to clamp a load of logs 38 therebetween. Retraction of the actuator will cause the arms to swing away from one another in an opposite manner to release the logs.

As shown in FIG. 2, the actuator 12 includes a housing 40 having a cylindrical bore 42 and an annular rod sealing member 44. An end portion 46 of the housing is of a construction sufficient for connection to the frame 14 of FIG. 1 at the anchoring pivot point 31, and the housing has a pair of ports 48 and 50 leading to opposite ends of the bore which are respectively in fluid communication with the rod and head end conduits 34 and 36.

More specifically, the actuator 12 has a reciprocable or telescoping piston therein as indicated generally by the numeral 52. The piston includes an elongate cylindrical rod 54 whose distal end is of eye-like construction sufficient for connection to the pivot joint 28 as shown in FIG. 1. A piston element or head 56 located generally at the proximal end of the piston and slidably engaged in the bore 42 defines a head end chamber 58 and a rod end chamber 60 within the housing 40. A cylindrical guide member 62 is secured to the inner end of the piston by a threaded fastener 64, and urging means 66 is provided in the head end chamber for continually biasing the piston outwardly or to the left when viewing FIG. 2. Preferably, the urging means is a coiled metal compression spring coaxially disposed in the head end chamber and in abutment with the end 46 of the housing and the piston element 56.

Referring now to the control means 33 illustrated in FIG. 2, it may be seen to include a control valve 68 which is manually controlled by a lever 70 through an intermediate mechanism 72 as is known in the art. The valve 68 includes a body portion or housing 74 having a bore 75 and a spool 76 reciprocably disposed in the bore. The spool has a plurality of lands 77, 79,81,83 and 85 and is positionable by the control lever 70 to a neutral position, as shown by the letter N, and several operating positions corresponding to a first position designated by the letter E for extending the actuator to close on a load of logs, a second position designated by the letter R for retracting the actuator to release the load, and a third position designated by the letter C for carrying the load of logs 38 from point to point. Each of the lands 77,85 preferably includes a respective slot 87,89 to provide a metering effect of the fluid flow therethrough and thus more precise control over the actuator 12.

The control valve 68 includes a plurality of annular chambers 78,80,82,84,86,88,90 and 92 formed circumferentially about and axially spaced along the bore 75. The annular chambers 78,86 and 92 are fluid drain passages which are interconnected by a fluid drain passageway 94. A port 102 is in fluid communication with the chamber 80 and the rod end conduit 34 to permit fluid flow between the rod end chamber 60 of the actuator 12 and the control valve 68. A plurality of ports 104,106 and 108 are connected to the annular chambers 82,84 and 88 for communicating fluid thereto as will be described hereinafter in greater detail. A port 110 is disposed in fluid communication between the annular chamber 90 and the head end conduit 36 to permit fluid flow between the head end chamber 58 of the actuator and the control valve. A make-up valve 111 is in fluid communication with the head end conduit 36 via a conduit 113 and a fluid reservoir 114 to permit additional fluid to be drawn into the head end chamber 58 should a vacuum be experienced thereat during operation of the actuator system 32. A port 112 is connected to the chamber 92 and a return conduit 115 to permit egress of fluid from the valve 68 to the reservoir 114.

Pressurized fluid is provided by a pump 116 which draws fluid from the reservoir 114. The pressurized fluid from the pump is communicated to a conduit 118 at a preselected maximum pressure as determined by the setting of a relief valve 120. The conduit 118 communicates fluid to a conduit 122 which is connected to the port 106 and a check valve 124 which protects the pump from back pressure surges arising from operation of the grapple 10. The check valve further communicates with a conduit 126 which in turn directs the fluid to a pair of conduits 128,130 for communication of fluid to the valve 68 via the ports 104,108.

Referring now to FIG. 3, there is shown an alternate embodiment actuator system 32' having commonalities with the actuator system 32 of FIG. 2, and wherein like reference numerals indicate corresponding parts throughout. The alternate embodiment performs the same general functions as the first embodiment. However, it provides the additional capability of selectively controlling the response time of the actuator 12 depending upon the size and weight of the load 38 and the condition of the terrain over which it is being transported. If, for example, a heavy load is being carried over a rough surface where it will be subjected to repeated bouncing and jarring, a fast response time is needed to prevent the load from dropping from the grapple arms. On the other hand, if a load is relatively light or if it is being transported over a smooth surface, a rapid response time may not be required. Thus, it may be seen that a selectively variable actuator response time is desirable. This feature is provided by the actuator system 32' which includes a control mass 33' having a first control valve 68' which is manually controlled by a control lever 70' through an intermediate mechanism 72' and a second control valve 121, which is illustrated symbolically in FIG. 3, controlled by a control lever 71 and an intermediate mechanism 73. The control valve 68' includes a spool 76' disposed in a bore 75 which is selectively positionable to a neutral position indicated by the letter N and two operating positions corresponding to a first position designated by the letter E for extending the actuator to close on the load 38 and a second position designated by the letter R for retracting the actuator to release the load.

The second control valve 121 is in fluid communication with the rod end conduit 34 via a conduit 123, with the head end conduit 36 via a conduit 125 and an orifice 128, with the reservoir 114 via a conduit 127, and with a conduit 129 having an orifice 130. The valve 121 is selectively positionable to a blocked or closed position 132, as shown, and three operating positions 134,136, and 138 for placing the actuator into an active biasing mode of operation against the forces exerted by a load of logs 38 when carrying them from one point to another. In order to avoid inadvertent movement of the control lever 70' to either the extending or retracting position while the valve 121 is in one of its three operating positions 134,136,138 interlock means 131 is provided. The interlock means 131 is disposed between the control levers 70' and 71 to automatically lock the lever 70' in the neutral position when the lever 71 is moved to shift the valve 121 out of the blocked or closed position 132.

In view of the foregoing it is readily apparent that the actuator system of the present invention is simple in construction, and yet it provides for automatic adjustment of the overall length of the actuator 12 in response to a change in the external forces acting thereon. Preferably, such system is utilized in conjunction with a clamping mechanism so that for any inadvertent shifting of the load the actuator will self adjust to more positively retain the load being carried without the need for operator attention. Furthermore, should there be any leakage in the system after an extended period of load holding time, the spring 66 provides a positive force tending to retain the load in the grasp of the grappling mechanism.

INDUSTRIAL APPLICABILITY

In the operation of the present invention as taught by the above detailed description, the log grapple mechanism 10 is secured to frame 14 of a log skidder. The self adjusting actuator system 32,32' including the actuator 12 and the actuator control means 33,33' is secured thereto for selectively opening and closing the grapple arms 18 and 20 to pick up, transport, and release a load of logs.

Referring to the first embodiment of the actuator system 32, when the spool 76 is in the neutral position as illustrated in FIG. 2, the ports 104 and 108 are blocked by the spool. Fluid from the pump 116 is directed by the conduit 118 through the port 106 into the chamber 84 whereupon it is further communicated to the fluid drain passage 94. The pressurized fluid is then relieved to the reservoir 114 via the chamber 92, the port 112, and the conduit 115. Flow between the head and rod end chambers 58 and 60 and the control valve 68 is blocked by the lands 83,85 and 77,79 disposed at either side of the chambers 90,80 respectively thereby holding the actuator fixedly in a preselected position.

To extend the actuator 12 to engage a load of logs 38 the control lever 70 is actuated which shifts the spool 76 to the first operating position shown as position E in FIG. 2, or to the left when viewing the drawing. Fluid flow through ports 104 and 106, is blocked by lands 79 and 81 respectively. Pressurized fluid from the pump 116 is communicated to the chamber 88 via conduits 118,122, check valve 124, conduits 126,130 and the port 108. The fluid is then directed into the chamber 90, through the port 110, and is further communicated by the head end conduit 36 to the head end chamber 58 via the port 50 where it urges the piston 52 to the left and extends the rod 54 of the actuator 12. Fluid in the rod end chamber 60 is forced through the port 48 and into the rod end conduit 34 in response to movement of the piston, whereupon it is communicated to the chamber 78 via the port 102 and the chamber 80. The fluid drain passage 94 thereafter communicates fluid from the chamber 78 to the chamber 92, the port 112, the conduit 115 and to the reservoir 114. Movement of the actuator can continue until the reactive force exerted on the grapple arms 18 and 20 by the load of logs equals the combined force of the spring 66 and the fluid pressure in the head end chamber 58 acting on the piston 52 or until the pressure exceeds the initial setting of the relief valve 120. Normally, however, the operator returns the spool 76 to its neutral position by manual movement of the lever 70 before the relief valve opens.

To release a load of logs, the spool 76 is shifted by the control lever 70 to a second operating position corresponding to position R as illustrated in FIG. 2, or to the right when viewing the drawing. Chamber 78 is then blocked by the land 77. The port 106 is blocked by the land 79, and the port 108 is blocked by land 83. Pressurized fluid from the pump 116 is communicated via conduits 118 and 122 to the check valve 124, whereupon it is directed to conduits 126 and 128 to the port 104 and into the chamber 82. Chamber 82 communicates the fluid to the chamber 80, and it is thereafter communicated by the port 102 to the rod end conduit 34, the port 48, and into the rod end chamber 60 where it urges the piston 52 to the right when viewing the drawing thereby retracting the actuator 12. In response to the movement of the piston 56, fluid in the head end chamber 58 flows through the port 50, into the head end conduit 36, through the port 110, the chamber 90, and into the chamber 92. The port 112 thereafter returns the excess fluid through the conduit 115 back to the reservoir 114.

To securely hold and carry a load of logs 38 in the grapple arms 18 and 20 as the load is transported from point to point, for example, from the harvesting site to a shipping point, the valve 68 is shifted to a third operating position corresponding to position C as illustrated in FIG. 2, or fully to the left when viewing the drawing. The ports 104,108, and 110 are blocked by the lands 79,83, and 85, and the head end chamber 58 is thereby blocked. Fluid from the pump 116 is directed to the chamber 84 via conduits 118,122 and the port 106 whereupon it is communicated to the chamber 86, and to the fluid drain passage 94. Thereafter, the chamber 92 and the port 112 vents the fluid to the reservoir 114 via the conduit 115. At the same time the rod end chamber 60 is also in open communication with the drain passage 94 via the conduit 34 and the intercommunicating chambers 78 and 80.

When initially in the third or carrying mode of operation the logs 38 are grasped firmly between the grapple arms 18 and 20 by the retained engaging pressure of the fluid in the head end chamber 58 and the force exerted by the compression spring 66 tending to extend the piston 52. Should the girth of the load happen to reduce due to vibration and a slight repositioning of the logs there is a decrease in the resisting force on the actuator. As a result, the retained pressure in the rod end chamber 60 decreases, and the force of the spring 66 urges the piston 52 to the left which extends the actuator 12 to maintain a firm grasp of the grapple arms 18 and 20 on the load. In response to outward movement of the piston 52, the fluid in the rod end chamber 60 is allowed to return to the reservoir via the rod end conduit 34, the chamber 80, the chamber 78, the fluid drain passageway 94, and the conduit 115. A vacuum is immediately created in the head end chamber 58 as a result of such movement and make-up valve 111 automatically opens to permit fluid flow from the reservoir 114 to the conduits 113 and 36 to keep the head end chamber substantially completely filled, which prevents the grapple arms from moving back to their former positions.

Referring now to FIG. 3, in operation of the alternate embodiment of the actuator system 32', the spool 76' of the first valve 68' is placed in the E position by manual movement of the control lever 70' and corresponding movement of the intermediate mechanism 72' to engage a load of logs 38 with the grapple arms 18 and 20. After the logs are engaged, the spool 76' is returned to the neutral position N thereby blocking the rod and head end conduits 34,36. The second valve 121 can then be placed into one of its three operating positions 134,136, or 138 by manual movement of the control lever 71 and corresponding displacement of the intermediate mechanism 73. In any of the three operating positions fluid pressure is relieved from the rod end chamber 60. Consequently, should vibration cause a slight shifting of the logs and a decrease in the girth of the log load the piston 52 will move to the left when viewing the drawing by action of the spring 66. The interlock mechanism 131 prevents accidental movement of the control lever 70' from the neutral position while the valve 121 is in any of the three operating positions 134,136, or 138.

In the first operating position 134 the fluid in the rod end chamber 60 is communicated directly to the reservoir 114 by the conduit 127 when the piston 52 is extended to provide a relatively fast response time to a shift in the load. In the second operating position 136, the system response time is controlled to a slower rate because the excess rod end fluid is communicated through the conduit 129 and the flow restricting orifice 130 to the reservoir 114. The system response time is slowest when the valve 121 is selectively placed in the third operating position 138. In this position the excess rod end fluid is communicated to the head end chamber 58 via the conduit 125 and the flow restricting orifice 128. In all three active positions, in the event that the piston moves to the left so quickly that a vacuum is experienced in the head end chamber 58, the make-up valve 111 connected between the head end conduit 36 and the reservoir 114 will open to permit additional fluid to be drawn into the head end chamber.

To release the load of logs 38 the control lever 71 is manipulated to shift the valve 121 to the closed position 132 and the control lever 70' is placed in the releasing or R position. The valve 68' subsequently directs pressurized fluid to the rod end chamber 60 and opens the head end chamber 58 to the reservoir 114. The force of the fluid on the piston 52 overcomes the force of the spring 66 and urges the piston toward the head end 46 of the actuator 12 to retract it. The grapple arms 18 and 20 open outwardly away from the logs thereby releasing them for further processing.

While the invention has been described with reference to two embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

We claim:

1. A self adjusting actuator system (32/32') comprising:

a fluid reservoir (114);

an actuator (12) having a housing (40), a telescoping piston (52) located within the housing (40) and defining first and second chambers (58,60) and urging means (66) for biasing the piston (52) in a preselected direction against an external force;

control means (33/33') for selectively supplying pressurized fluid to either of the chambers (58,60), the control means (33/33') including control valve means (68/68'), the control valve means (68/68') further including a control spool (76/76') having first and second operating positions corresponding to extending and retracting the actuator (12), and a third operating position, said control valve means (68/68') having valve means (34,102,80,75,78/34,123,121) for egress of fluid from the second chamber (60) in the third operating position of the control spool (76/76') in response to a change in the external force and movement of the piston (52) by the urging means (66), said control spool (76/76') obstructing pressurized fluid flow to said chambers (58,60) in said third operating position; and means (111,113,36) for ingress of make-up fluid from said reservoir (114) into the first chamber (58) in the third operating position of the control spool (76/76') in response to movement of the piston (52) effected by said urging means responsive to a change in said external force.

2. The actuator system of claim 1 including means (83,85) for preventing egress of fluid from said first chamber (58) in the third operating position of the control spool (52).

3. The actuator system of claim 1 wherein said first chamber (58) and said second chamber (60) correspond to a head end chamber (58) and a rod end chamber (60), respectively.

4. The actuator system of claim 1 wherein said urging means (66) is a metal compression spring (66) in contact with said piston (52).

5. The actuator system of claim 1 wherein said means (111,113,36) for ingress of makeup fluid includes a check valve (111).

6. The actuator system of claim 1 wherein said urging means (66) urges said piston (52) outwardly of the housing (40) in response to a reduction in said external force.

7. The actuator system of claim 1 further including guide means (62) for guiding said urging means (66) biasing said piston (52).

8. The actuator system of claim 2 including a source (116) of pressurized fluid connected to said control valve means (68/68'), head end passage means (36,50) for communicating fluid between said control valve means (68/68') and said head end chamber (58), and rod end passage means (34,48) for communicating fluid between said control valve means (68/68') and said rod end chamber (60).

9. The actuator system of claim 1 wherein said actuator (12) is mounted on a load clamping mechanism (10) having a frame (14) and at least one movable clamping arm (18,20) on said frame (14), said actuator (12) and said load clamping mechanism (10) being so constructed and arranged that said arm (18,20) is clamped upon a load (38) in response to extension of said actuator (12).

10. The actuator system of claim 1 wherein said valve means (34,102,80,75,78/34,123,121) for egress of fluid from the second chamber (60) includes a second control valve (121).

11. The actuator system of claim 10 wherein said second control valve (121) has an operating position for communicating fluid from said second chamber (60) to a reservoir (114) in response to movement of the piston (52) by the urging means (66).

12. The actuator system of claim 10 wherein said second control valve (121) has an operating position for communicating fluid from said second chamber (60) through a flow restricting orifice (130) to a reservoir (114) in response to movement of the piston by the urging means (66).

13. The actuator system of claim 10 wherein said second control valve (121) has an operating position for communicating fluid from said second chamber (60) to said first chamber (58) in response to movement of the piston (52) by the urging means (66).

14. The actuator system of claim 10 including interlock means (131) for preventing operation of said control valve means (68/68') in response to operation of said second control valve (121).

* * * * *